United States Patent [19]

Dryer et al.

[11] Patent Number: 4,969,264

[45] Date of Patent: Nov. 13, 1990

[54] CATALYTIC COVERTER AND SUBSTRATE SUPPORT

[75] Inventors: Leonard J. Dryer, Harrisonburg, Va.; Thomas J. Schwarte, Plymouth, Ind.

[73] Assignee: Tennessee Gas Pipeline Company, Lincolnshire, Ill.

[21] Appl. No.: 156,838

[22] Filed: Apr. 1, 1988

Related U.S. Application Data

[63] Continuation-in-part of Ser. No. 873,684, Jun. 12, 1986, abandoned.

[51] Int. Cl.[5] ..... F01N 3/28; B21D 39/03; B23P 11/00

[52] U.S. Cl. ..... 29/890; 29/516; 422/179

[58] Field of Search ..... 29/157 R, 516; 422/179

[56] References Cited

U.S. PATENT DOCUMENTS

| | | | |
|---|---|---|---|
| 3,227,241 | 1/1966 | Mattoon | 422/180 |
| 3,313,536 | 4/1967 | Dutton et al. | 29/516 |
| 3,523,590 | 8/1970 | Straw | 29/157 R X |
| 3,990,859 | 11/1976 | Waite | 29/157 R X |
| 4,020,539 | 5/1977 | Vroman | 29/157 R X |
| 4,048,363 | 9/1977 | Langer et al. | 422/180 |
| 4,087,039 | 5/1978 | Balluff | 29/455 R |
| 4,155,980 | 5/1979 | Santiago et al. | 422/179 X |
| 4,256,700 | 3/1981 | Smith et al. | 422/177 |
| 4,343,074 | 8/1982 | Bailey et al. | 29/157 R |
| 4,344,922 | 8/1982 | Santiago et al. | 422/179 |
| 4,347,219 | 8/1982 | Noritake et al. | 422/180 |
| 4,362,700 | 12/1982 | Hayashi et al. | 422/179 |
| 4,413,392 | 11/1983 | Otani et al. | 29/157 R |
| 4,504,294 | 3/1985 | Brighton | 55/502 |
| 4,629,605 | 12/1986 | Santiago | 422/179 |

*Primary Examiner*—Robert J. Warden
*Assistant Examiner*—Amalia Santiago
*Attorney, Agent, or Firm*—Harness, Dickey & Pierce

[57] ABSTRACT

A catalytic converter of the automotive type comprises a converter housing body with a reduced central section that compresses a support mat around a substrate, the ends of the body being spherical for attachment to spherical flanges on end bushings or being an integral part of the body. The method of manufacturing the converter substrate and converter is also disclosed.

15 Claims, 3 Drawing Sheets

CATALYTIC COVERTER AND SUBSTRATE SUPPORT

CROSS-REFERENCE TO RELATED APPLICATIONS

This is a division and continuation-in-part of application Ser. No. 873,684, filed June 12, 1986, now abandoned.

BACKGROUND OF THE INVENTION

This invention relates to catalytic converters for internal combustion engine exhaust systems and, in particular, to catalytic converters intended for installation in motor vehicles as original equipment by the vehicle manufacturer or as aftermarket replacements for original equipment converters.

BRIEF SUMMARY OF THE INVENTION

It is the purpose of the invention to reduce the size and number of parts in a catalytic converter (as compared with known practical constructions) while at the same time increasing its effectiveness and improving its construction and manufacture.

The invention achieves the foregoing purpose by means of a substrate support in the form of a tubular converter body which is reduced in diameter at a central portion to compress a support mat around a catalyst substrate. In one form, the ends of the body are formed to a spherical radius to produce a converter substrate support that can be shipped "as is" or assembled at once into a converter. This form of converter is completed by attaching inlet and outlet bushings to the ends of the substrate support and this can be done in the factory or at some point downstream. In another form, the body is in two halves, each of which has a bushing formed in it. One of the halves is reduced in diameter to hold the substrate and the other half is pressed over and secured to it.

This invention provides a construction and manufacture that results in a converter that is quite short in length, has few parts, has maximum effectiveness since 100% of the substrate end faces can be used, and has improved accuracy of substrate support, along with other advantages that will become apparent or be mentioned hereinafter.

DESCRIPTION OF THE PREFERRED EMBODIMENTS

Figure 1:
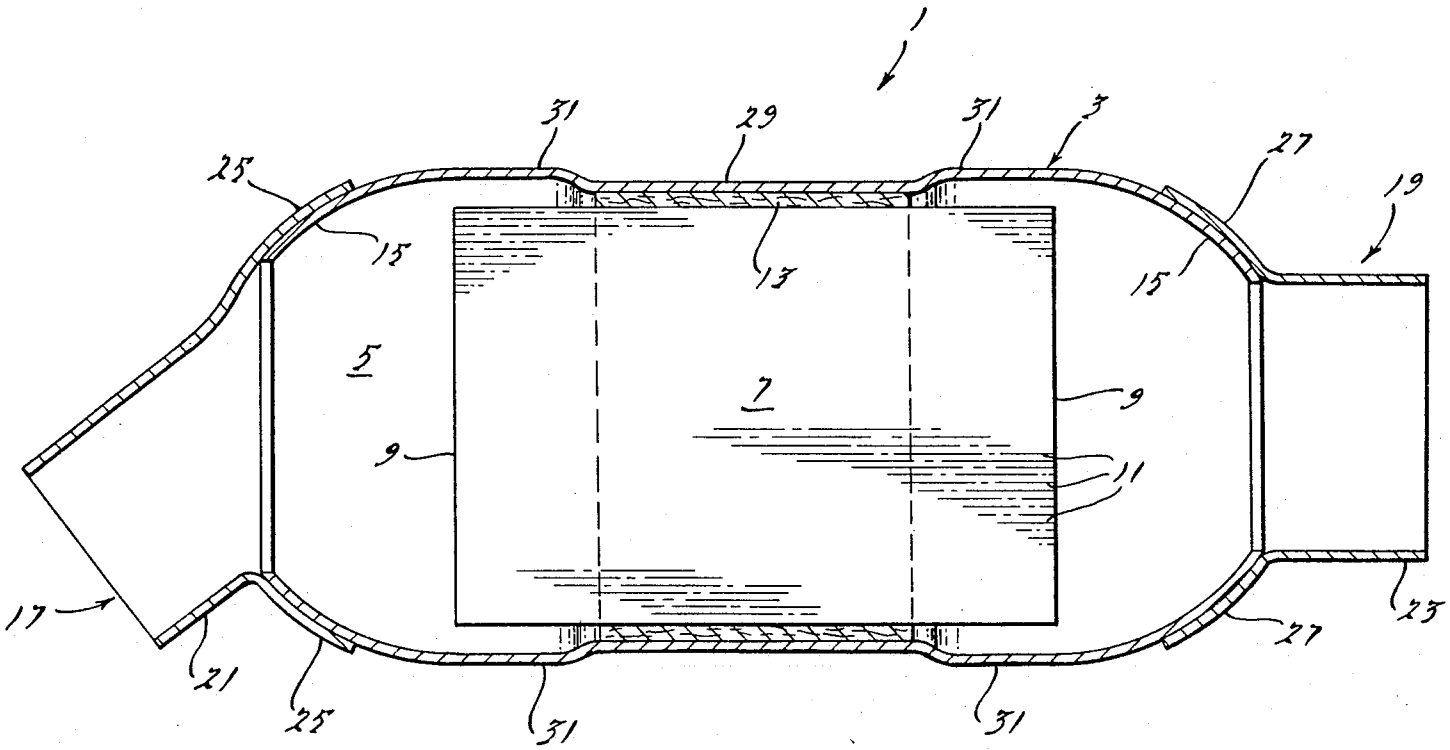
FIG. 1 is a longitudinal cross-section along the centerline or axis of a preferred form of converter embodying the invention.

Referring to FIG. 1, a catalytic converter 1 embodying the invention for use in motor vehicle exhaust gas systems comprises an open ended, tubular, preferably round and symmetrical, sheet metal body 3, the inside of which defines a chamber 5 for a round, symmetrical, ceramic monolith, honeycomb-type, catalyst substrate 7 (available on the open market) having flat ends 9 and a great number of catalyst coated, longitudinal honeycomb cell passages 11 extending from one end 9 to the other. The central portion of the substrate 7 (less than the full length) is surrounded by an annular, shock absorbent, resilient, insulative, support mat 13, which is preferably composed of a gas impervious vermiculite based material (available on the open market) that expands substantially upon heating. This is preferably about ¼' thick and radially compressed at assembly to about one half of its initial thickness. The opposite end portions 15 of the body 3 are preferably each formed or swaged to a partially spherical shape as illustrated having central openings substantially less in diameter than the diameter of substrate 7. Gas flow end bushings 17 and 19 have tubular outer ends 21 and 23, respectively, for attachment by welding or clamping, or otherwise, to exhaust system conduits (not shown). They also have outwardly flared annular partially spherical inner end flanges 25 and 27, respectively, each of which is preferably formed on a radius corresponding to that of the body end portions 15 to which they are welded in selected locations so that their ends 21 and 23 have the desired orientation with respect to the centerline or axis of the body 3. End 21 is shown oblique and end 23 is shown coaxial, but many other angular arrangements are accommodated by the mating spherical surfaces.

The body 3 is preferably formed from a length of uniform diameter and thickness metal tubing. The substrate 7, with the annular mat band 13 located centrally on it, is positioned centrally in chamber 5 and coaxially inside the tubing which is then uniformly reduced in diameter by suitable known means (e.g., see U.S. Pat. No. 3,382,948, FIGS. 2 and 2A) into a central, reduced diameter ring portion 29 of about the same length as mat 13 thereby uniformly radially compressing the mat around the outside of the substrate to about one-half its original or free state thickness, thus firmly though somewhat resiliently supporting the substrate in centered position. The ring portion 29 retains radial compression on the mat 13 and the two apply sufficient radial pressure to resiliently retain it in a centered position and serve as the sole means to shock mount and support the ceramic monolith. The body 3 has intermediate substantially uniform diameter portions 31 extending between opposite or outer ends of the central ring portion 29 and the inner ends of the spherical end portions 15, the spherical portions 15 being formed in the metal body 3 after the ring 29 is formed to hold the substrate in place. The portions 31 are radially spaced outwardly from the substrate 7 and preferably extend to about the ends 9 of the substrate whereupon the curvature into spherical end portions 15 begins.

If desired, bushings such as 17 and 19 can, after formation of end portions 15, be welded in place at the factory. Alternatively, the converter substrate, or body 3 with the substrate 7 and formed ends 15, can be sent downstream to the vehicle manufacturer, warehouse, repair shop, etc., where the desired end bushings can attached to suit specific applications.

From the standpoint of a method of manufacture of converter 1, the body 3 is preferably initially in the form of a simple metal tube of uniform diameter, open at both ends. The mat 13 is placed around the midsection of the substrate 7 and this assembly is inserted or stuffed into the tube so that it is longitudinally and radially centered in the tube. While maintaining this centered relationship, the wall of the tube is radially compressed into the reduced diameter ring selection 29 which, by way of its radial contact with the mat 13, radially compresses it and applies radial pressure to the substrate 7. The radial deformation of ring 29 is sufficient to apply and retain enough radial pressure on the mat and substrate to permit shock absorption by the mat but still hold the substrate centered in the tube so that its end corners do not come in contact with the inner wall surface of the tube. After formation of the ring 29 so that the substrate 7 is held in place, radial pressure is applied to the ends of the tube to deform them inwardly into the spherical end portions 15 while still maintaining the sections 31 substantially cylindrical to preserve the clearance between them and the substrate 7. This completes the converter substrate and the converter is completed by welding the bushings 17 and 19 in place on the end portions 15. Alternatively, one of the spherical end portions 15 could be formed in the body before the substrate is inserted through the other end and held in place by formation of ring 29.

Figure 5:
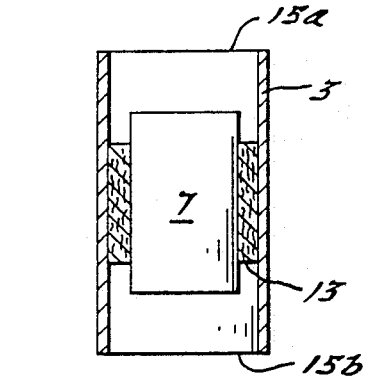
FIGS. 5–10 show one method of forming the catalytic converter shown in FIG. 1.
Figure 7:
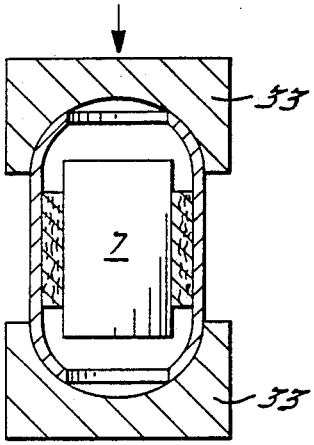

Referring to FIGS. 5–10, an alternative method of manufacturing is disclosed. In FIG. 5, mat 13 and substrate 7 are assembled as before and the assembly inserted into the tube which is open at its opposite axial ends indicated as **15*a* and 15*b*. While maintaining a longitudinally and radially centered relationship between ring 29 and mat 13, in FIGS. 6 and 7, a pair of forming dies 33 are positioned such that each die 33 is adjacent one of the opposite ends 15*a* and 15*b* of the tube, each die having a generally hemispherical surface 35 that defines a forming cavity 37. The dies are then axially advanced against the tube ends such that axial end portions of the tube are driven into the cavities 37 whereby the contoured hemispherical surfaces 35 progressively deform the tube end portions into the generally spherical end portions 15. Forming dies 33 simultaneously apply radial and axial pressures on the axial end portions to deform same and while the diameter of cavity 37 is greater than that defining the tube, the contour of surface 35 could be other than hemispherical if desired. Since the application of compressive axial force by dies 33 precedes formation of reduced portion 29**, the column strength of the tube is retained to avoid wall collapse during shaping of the tube ends.

Figure 9:
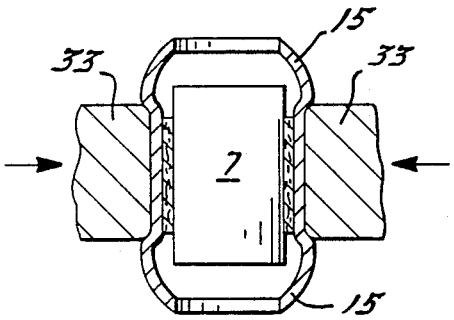
Figure 6:
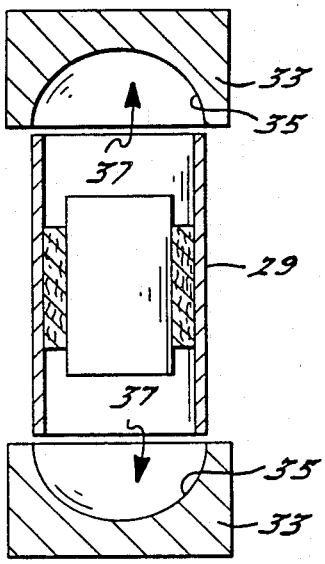
Figure 8:
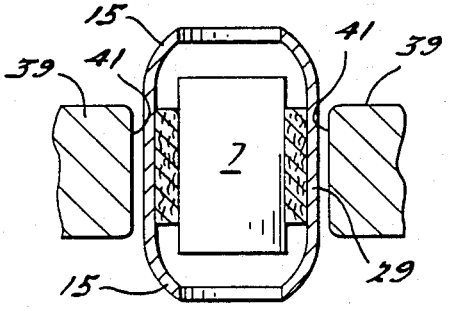
Figure 10:
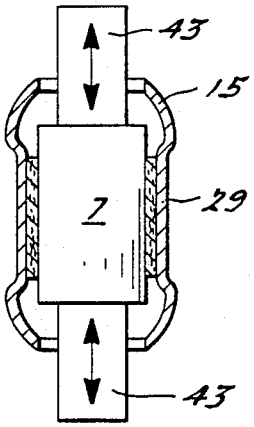

In FIGS. 8 and 9, two or more compression dies 39 each having a circular semicylindrical forming surface 41 are positioned about and simultaneously driven radially inwardly about the central portion 29 of the tube thereby resulting in the tube wall being uniformly radially deformed and driven into compressing contact with mat 13. The axial width of each forming surface 41 is selected to be substantially coextensive with that of mat 13. Desirably the angular extent of surfaces 41 is such that when the compression dies 39 reach their inwardmost travel the respective surfaces 41 cooperate to define a continuous 360° surface. Advantageously the compression dies assure that mat 13 is properly reduced in thickness and compressed radially between the substrate and the inner wall of the tube. FIG. 10 indicates that should the substrate need repositioning, arbors 43 are inserted through the openings formed by the hemispherical ends.

In use, the converter 1 would normally be secured into an exhaust system by welding or clamping of bushing portions 21 and 23 to exhaust system conduits. Either end can be the inlet. Exhaust gas flows through the longitudinal passages 11 which are catalyst coated to reduce oxides of nitrogen and to oxidize hydrocarbons and carbon monoxide in order to achieve acceptable emission levels. If a vermiculite base mat 13 is used, heat from the reaction during initial operation of the converter will cause it to significantly expand thereby enhancing the tightness of the connection between the substrate 7 and body 3 to act along with the relatively high frictional resistance to resist slipping of the substrate relative to the body 3. For the aftermarket, the substrate 7 will be selected, sized, and treated with catalyst to produce acceptable emission levels for a wide variety of different engines.

As an example of approximate size for automotive applications, the substrate 7 may be about 4" 0.D. and about 5" long, and uniformly spaced about ⅛" from the inner surface of ring 29 and about ¼" from the inner surface of intermediate portions 31, and the overall length of the body 3 after forming of the spherical ends may be about 7–7½'. This is significantly less length than needed to support the substrate in a conventional manner in a similarly shaped body by means of L-shaped support rings. Additionally 100% of the end faces 9 and longitudinal passages 11 of the substrate can be used for conversion thereby increasing converter effectiveness. A further comparison with the L-ring support method shows that the number of parts in converter 1 has been reduced to only five and that the method of supporting the substrate by uniform radial compression applied through ring 29 achieves more accuracy in manufacturing thereby reducing the likelihood of scrap. The spherical end portions 15 and bushings 17 and 19 provide a "universality" feature that promotes smaller inventory, better service, and lower costs. The body 3, without bushings 17 and 19, comprises a substrate support which can be shipped with reduced likelihood of impact damage to the brittle ceramic substrate material because of the protection provided by the spherical ends and by the unique method of mounting the substrate which provides ample clearance for the corners of the substrate.

Figure 2:
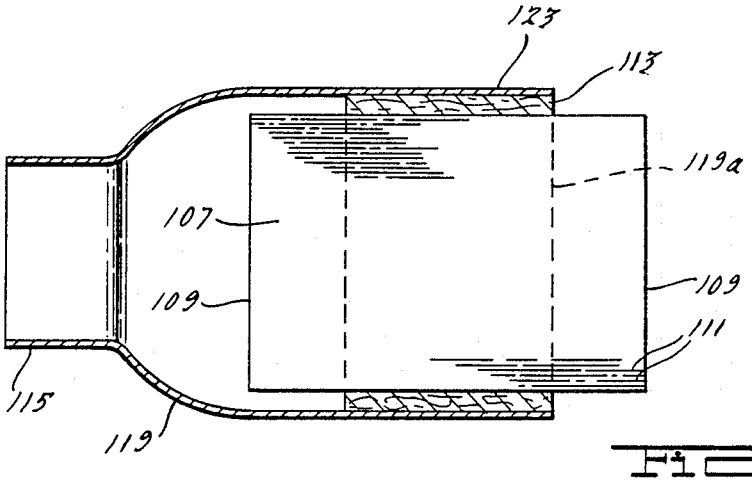
FIG. 2 is a longitudinal cross-section through one half of another form of the invention showing the mat and substrate after stuffing.
Figure 3:
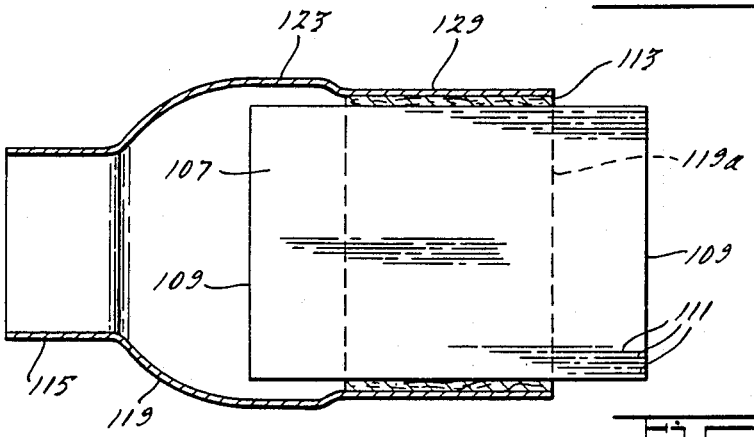
FIG. 3 is a section similar to FIG. 2 but showing the parts after reduction in diameter.
Figure 4:
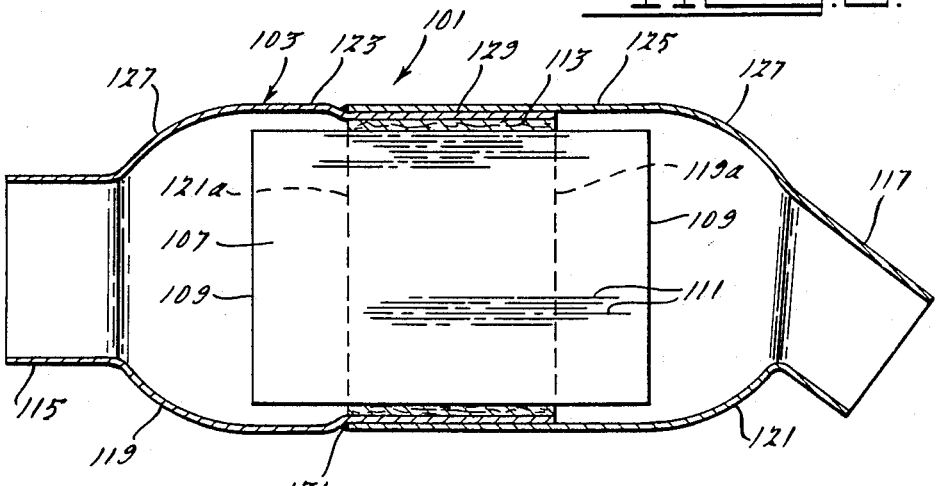
FIG. 4 is a longitudinal cross-section through the completed converter of FIGS. 2 and 3.

Referring to FIGS. 2–4, the invention is illustrated in the form of a converter 101 (FIG. 4) having an elongated, round tubular body 103 containing a catalyst substrate 107 (preferably the same as substrate 7) with flat ends 109 and longitudinal honeycomb cell gas passages 111 extending from one end of face 109 to the other. The central portion of substrate 107 is surrounded by a support mat 113 which is preferably the same as mat 13. Gas flow end bushings 115 and 117 are preferably integral with and formed by swaging or deforming metal in the ends, respectively, of body halves 119 and 121 which telescope together to form the body 103. Halves 119 and 121 may be formed or swaged and drawn from originally round cylindrical tubes that have uniform diameter and wall thickness inner end portions 123 and 125, respectively. Outer portions 127 of the halves are formed into segments that blend into the integral bushings 115 and 117. Segments 127 are illustrated as spherical, bushing 115 as coaxial with body 103, and bushing 117 as oblique to the axis of body 103.

As seen in FIG. 2, the substrate 107 and its central and symmetrically located mat 113 have an outer diameter which is about the same as the inner diameter of end portion 123 of body half 119 whereby the combined substrate and mat can be stuffed into the open end **119*a* of the half 119 and positioned with the outer end of the mat substantially coplanar with the end 119***a* (allowance preferably being made for longitudinal mat expansion as a result of radial compression). As seen in FIGS. 3 and 4, the end of portion 123 is reduced in diameter along section 129 by about the wall thickness of the halves 119 and 121 which is about 50% of the original thickness of mat 113. Reduced diameter section 129 is substantially the same in length as the compressed mat.

As seen from FIG. 4, the open end 121*a* of half 121 is telescoped over the reduced diameter section 129 of half 119 so that end portion 125 slides over section 129 for a desired length of overlap, the overlap illustrated in FIG. 4 being the length of mat 113 and section 129 though the overlap may be less. Thereafter, the end portion 125 and half 121 can be affixed to end portion 123 and half 119 as illustrated by the annular weld 131.

From the standpoint of a method of manufacture of converter 101, the two halves 119 and 121 are preferably initially each in the form of simple metal tubes of uniform diameter and open at both ends. One end of each of the halves is deformed by suitable drawing or swaging operations or the like to form sections 127 and the integral bushings 115 and 117 bearing the desired orientation with respect to the axis of the tube. The mat 113 is wrapped around the substrate, preferably being symmetrical with respect to the ends as illustrated, and this assembly stuffed into one of the halves (e.g., half 119) so that the trailing end of the mat is approximately coplanar with the end of the half (e.g., end 119*a*). Thereafter, the wall of the half containing the substrate is radially compressed into ring 129, the deformation along a radius preferably being substantially the wall thickness of metal tube from which the halves 119 and 121 are formed. The converter assembly is then completed by sliding or telescoping the second half (e.g., half 121) over the ring 129 (which now has an outer diameter that is substantially the same as the inner diameter of the second half) for the desired amount of overlap and welding or otherwise affixing the two halves together. If both bushings 115 and 117 are oblique to the axis of converter 101, the second half will also be angularly positioned in the desired location before it is welded to the first half.

While halves 119 and 121 are shown with integral end bushings 115 and 117, the integral bushings 115 and 117 could be omitted (so that the body 103 is a substrate support) and the gas flow bushings could be add-ons as shown at 17 and 19 for converter 1 in FIG. 1 in which case it would be important to have the end sections of the halves spherically shaped as shown at 127. Another modification would be to have spherical ends 127 with no openings at all (except for an air vent for assembly purposes, if necessary) whereby the installer of the converter would cut the gas flow openings at the desired positions and weld on end cap type bushings such as 17 and 19 of FIG. 1. This modification provides maximum protection against damage to the substrate during shipping and storage. The basic idea of spherical ends, open and closed, for a catalyst converter is disclosed and claimed in an abandoned application assigned to the assignee hereof of Robert L. Sager, Jr., filed Mar. 31, 1986, Ser. No. 846,058, entitled Automotive Type Catalytic Converter.

For best results, it is important in both converters 1 and 101 to select the appropriate length for the mat 13 or 113. If the mat is too long, fibers may break off or be liberated by gas pulsations and get into the longitudinal cell passages 11 or 111 and plug them. Also, if the mat is too long a phenomenon known as "ring-off" may occur that could produce temperature gradients on the substrate that would put it in tension which could lead to cracking in the center. On the other hand, if the mat is too short, the substrate could rock or resonate causing damage if it impacts on the metal body 3 or 103. To minimize these possibilities, it is desirable that the mat length be in the range of 50% to 90% of the substrate length, preferably about 60%. At these lengths, there is special benefit in that it is believed that a static condition develops in the space between the outer diameter of the exposed ends of the substrate and the walls of the bodies 3 and 103 wherein the gas is relatively stagnant. This is thought to protect the ends of the mat and tend to minimize the chance that fibers will come loose and get into the substrate.

Modifications may be made in the specific details shown and described without departing from the spirit and scope of the invention. For example, while spherical end portions 15 are preferred for converter 1, advantages of the invention will still be obtained if conventional end cone bushings are attached to sections 31 instead of the flange bushings 17 and 19 that are shown.

We claim:

1. A method of assembly a catalytic converter of the motor vehicle type which comprises preassembling an annular gas impervious shock absorbent support mat only around the mid-section of a catalyst substrate to form a preassembly, inserting the preassembly into a tubular body of metal so as to be in centered, spaced, relation to the interior wall of said body, radially deforming the wall of the metal body into a reduced diameter annular ring in radial contact with said annular mat, said deforming step substantially simultaneously applying uniform inward radial pressure on said mat and radially compressing he mat to substantially reduce its thickness and to apply sufficient radial pressure against the substrate to hold the substrate in the body.

2. A method as set forth in claim 1 including the added step of applying radial pressure to the body to radially deform it inwardly and into an end portion of predetermined annular shape.

3. A method according to claim 1 wherein the preassembly is longitudinally and axially centered in the body and wherein said annular ring is formed from a central portion of the wall of the body.

4. A method according to claim 1 wherein the preassembly is inserted into the body so that it is axially centered in the body but one end portion beyond the mat extends out of the body and wherein an end portion of the wall of the body is deformed into said annular ring and including the steps of telescoping a second hollow metal body over said annular ring and securing the second body to the first body in said telescoped condition.

5. A method of assembling an automotive type catalytic converter which comprises deforming a first end of a first tubular metal body of uniform diameter into a gas flow end bushing, a deforming a first end of a second tubular metal body of uniform diameter into a second gas flow end bushing, preassembling an annular, gas impervious, shock absorbent mat only around a mid-section of a catalyst substrate, inserting the preassembly into the first end of the first body so that the outer end of the mat is radially aligned with the end of the first body, radially deforming the wall at a second end of the first body into a reduced diameter annular ring in radial contact with the annular mat to apply and retain radial pressure on and radially compress the mat to substantially reduce its thickness and to apply sufficient radially pressure against the substrate to hold the substrate in the first body, said forming substantially simultaneously applying uniform circumferential pressure to the entire outer surface of said support mat, and telescoping the first end of the second body over said ring and securing the first and second bodies together.

6. A method according to claim 5 including deforming the wall of the first end of the first body by a radial distance substantially the same as the wall thickness of the first end of the second body.

7. A method according to claim 2 wherein said body is generally cylindrical and includes a pair of axially spaced outer ends each terminating in a respective axial end portion, and the step of applying radial pressure to the outer end of the body includes applying axial and radial pressure simultaneously to both outer ends of the tube to deform each end portion into the predetermined shape, said step preceding the step of radially deforming the wall of said metal body.

8. In a method of making a catalytic converter of the type wherein a resilient annular support member is radially sandwiched between the inner wall of a hollow cylindrical tube and the outer periphery of a catalyst, the improvement comprising the steps of assembling a gas impervious support member about the mid-section of the catalyst to form a preassembly, inserting the preassembly into the tube such that the preassembly is disposed centrally relative tot he longitudinal axis of the tube and between opposite axial end portions thereof, and radially deforming said tube portions such that each said end portion is formed into a generally hemispherical shape and said tube is reduced generally simultaneously uniformly radially inward to reduce the tube in diameter and to reduce the thickness of the support member by an amount sufficient to supply radial pressure against the substrate to hold the substrate in the body.

9. A method as recited in claim 8 wherein the end portion deforming step precedes the diameter reducing step.

10. A method as recited in claim 8 wherein the diameter reducing step precedes the end portion deforming step.

11. A method as recited in claim 8 comprising making the support member from a generally nonmetallic gas impervious material.

12. A method as recited in claim 11 comprising making said support member from vermiculite.

13. A method as recited in claim 8 wherein said catalyst is generally cylindrical and has opposite axial end faces, and wherein the inserting step comprises axially centering said support member on said catalyst such that axial extensions of the support member are axially inward from each axial end face of the catalyst.

14. A method as recited in claim 8 wherein said diameter reducing step reduces the support member in place about the catalyst thereby maintaining unreduced diameter portions in the tube between the hemispherical shapes end portions and the centrally reduced portion.

15. A method as recited in claim 14 wherein assembling step includes suitably sizing the catalyst such that axial extensions thereof do not extend into the unreduced diameter portions following the diameter reducing step.

* * * * *

UNITED STATES PATENT AND TRADEMARK OFFICE

CERTIFICATE OF CORRECTION

PATENT NO. : 4,969,264

DATED : Nov. 13, 1990

INVENTOR(S) : Dryer et al.

It is certified that error appears in the above-identified patent and that said Letters Patent is hereby corrected as shown below:

In the Title: "Coverter" should read --Converter--.

Col. 2, Line 11, delete "1/4'"and insert --1/4"--.

Col. 4, Line 20, delete "7-7-1/2'" and insert --7-7-1/2"--.

Col. 6, Line 25, delete "assembly" and insert --assembling--.

Col. 6, Line 36, delete "he" and insert --the--.

Col. 6, Line 59, delete "a" first occurrence.

Col. 7, Line 3, delete "radially" and insert --radial--.

Col. 7, Line 30, delete "tot he" and insert --to the--.

Col. 8, Line 3, delete "supply" and insert --apply--.

Signed and Sealed this

Twenty-seventh Day of April, 1993

*Attest:*

MICHAEL K. KIRK

*Attesting Officer*

*Acting Commissioner of Patents and Trademarks*